US007584556B2

(12) United States Patent
Fujita et al.

(10) Patent No.: US 7,584,556 B2
(45) Date of Patent: Sep. 8, 2009

(54) FOOTGEAR AND INSOLE

(75) Inventors: Minoru Fujita, Kobe (JP); Ryoko Murotani, Toyama-ken (JP)

(73) Assignee: Foot Techno, Inc., Hyogo-ken (JP)

( * ) Notice: Subject to any disclaimer, the term of this patent is extended or adjusted under 35 U.S.C. 154(b) by 680 days.

(21) Appl. No.: 11/340,405

(22) Filed: Jan. 25, 2006

(65) Prior Publication Data

US 2006/0265904 A1 Nov. 30, 2006

(30) Foreign Application Priority Data

Jan. 26, 2005 (JP) ..... 2005-018893

(51) Int. Cl.
*A43B 13/40* (2006.01)

(52) U.S. Cl. ..... 36/141; 36/43

(58) Field of Classification Search ..... 36/43, 36/44, 141, 92

See application file for complete search history.

(56) References Cited

U.S. PATENT DOCUMENTS

| | | | | |
|---|---|---|---|---|
| 4,694,831 | A * | 9/1987 | Seltzer | 36/141 |
| 5,400,526 | A * | 3/1995 | Sessa | 36/3 B |
| 5,551,173 | A * | 9/1996 | Chambers | 36/44 |
| 5,553,398 | A * | 9/1996 | Schnewlin-Maier | 36/43 |
| 5,625,965 | A | 5/1997 | Blissett et al. | |
| 5,685,094 | A * | 11/1997 | Lin | 36/141 |
| 6,178,662 | B1 * | 1/2001 | Legatzke | 36/3 R |
| 6,205,684 | B1 * | 3/2001 | Snyder | 36/35 R |
| 6,234,987 | B1 * | 5/2001 | Chen | 601/85 |
| 6,715,221 | B1 * | 4/2004 | Sasaki | 36/141 |
| 6,742,289 | B2 * | 6/2004 | Celmo | 36/141 |
| 7,441,349 | B2 * | 10/2008 | Seydel et al. | 36/114 |
| 2004/0103558 | A1 * | 6/2004 | Everz | 36/43 |
| 2004/0111924 | A1 * | 6/2004 | Riccardi | 36/141 |
| 2004/0134103 | A1 * | 7/2004 | Kohler et al. | 36/71 |
| 2004/0255488 | A1 * | 12/2004 | Brooks | 36/44 |
| 2008/0184594 | A1 * | 8/2008 | Ebeling | 36/11.5 |

FOREIGN PATENT DOCUMENTS

| | | | |
|---|---|---|---|
| CN | 2627871 | Y | 7/2004 |
| CN | 2636631 | Y | 9/2004 |
| CN | 266227 | Y | 12/2004 |
| CN | 2666227 | Y | 12/2004 |
| JP | 3026518 | | 7/1996 |

(Continued)

OTHER PUBLICATIONS

Translation of Office Action received for corresponding Chinese Patent Application No. 2006100071727, mailed on Oct. 24, 2008. Information Sheet for Documents B and C Above (Date N/A).

(Continued)

*Primary Examiner*—Marie Patterson
(74) *Attorney, Agent, or Firm*—Marsh Fischmann & Breyfogle LLP

(57) ABSTRACT

An insole has a heel support including a projection that presses and stimulates the tibial nerve and the medial sural cutaneous nerve, which are located in the proximity of the tuber calcanei of the foot. The insole corrects the shape of the arch of the sole and thus improves blood circulation.

20 Claims, 10 Drawing Sheets

FOREIGN PATENT DOCUMENTS

| | | |
|---|---|---|
| JP | 2000-083706 | 3/2000 |
| JP | 3075369 | 2/2001 |
| KR | 20-0201935 | 11/2000 |
| KR | 20-0205881 | 12/2000 |
| KR | 20-0318276 | 6/2003 |

OTHER PUBLICATIONS

Office Action issued in corresponding Japanese Patent Application No. 2006-017777, dated Jun. 2, 2009.

Translation of Office Action received for corresponding Chinese Patent Application No. 2006100071727, mailed on Oct. 24, 2008.

* cited by examiner

FOOTGEAR AND INSOLE

BACKGROUND OF THE INVENTION

The present invention relates to footgear including shoes, Japanese geta clogs, slippers, sandals, high heels, and socks, and insoles.

Typically, a heel support formed in footgear or an insole for supporting the heel has an upper surface that is shaped substantially flat or concave in a dish-like manner. As proposed in Japanese Laid-Open Patent Publication No. 2000-83706, a number of projections may project from the upper surface of the heel support. This structure presses and stimulates the bottom surface of the heel, thus promoting blood circulation in the foot.

Japanese Utility Model No. 3026518 discloses an insole for footgear. The insole includes a heel support with a magnet, which presses and stimulates the bottom surface of the heel. Further, Japanese Utility Model No. 3075369 discloses a sock. The sock includes a heel support with a plate-like body, which presses and stimulates the bottom surface of the heel.

Further, footgear or an insole having a shock absorbing material that is provided in a heel support is publicly known.

Normally, as shown in FIG. 9, a human sole includes an inner longitudinal arch A1 located closest to the big toe, an outer longitudinal arch A2 located closest to the little toe, and a lateral arch A3 extending from the base of the big toe to the base of the little toe. The arches A1 to A3 are formed through actions of bones and muscles and form a substantially triangular shape, as viewed from above. However, as the functions of the muscles and tendons of the foot are weakened by aging or illness, the arches A1 to A3 may deform to cause a flatfoot, a clubfoot, a valgus foot, a metatarsus latus, or a bowleg. In walking, flexing motion of the arches A1 to A3 promotes the blood circulation (pumping action) of the foot. Such blood circulation is decreased by the deformation of the arches A1 to A3. Also, the deformation of the arches A1 to A3 increases impact acting on the bone structure of the foot when the heel hits the ground. This increases fatigability of the foot in walking.

The heel supports formed in the conventional footgear and insole press and stimulate the bottom surface of the heel, but cannot correct the deformed arches A1 to A3.

SUMMARY OF THE INVENTION

Accordingly, it is an objective of the present invention to provide footgear and insoles that correct the shape of the arch of the sole.

To achieve the foregoing and other objectives and in accordance with the purpose of the present invention, the invention provides footgear having a sole support that supports the sole of the foot. The sole support includes a heel support supporting the heel. The footgear includes a projection formed on the heel support for pressing and stimulating a nerve in the proximity of the tuber calcanei of the foot.

The present invention also provides an insole having a sole support that supports the sole of the foot. The sole support includes a heel support that supports the heel. The insole includes a projection provided on the heel support for pressing and stimulating a nerve in the proximity of the tuber calcanei of the foot.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Hereinafter, an embodiment of the present invention will be described with reference to FIGS. 1 to 9.

Figure 1:
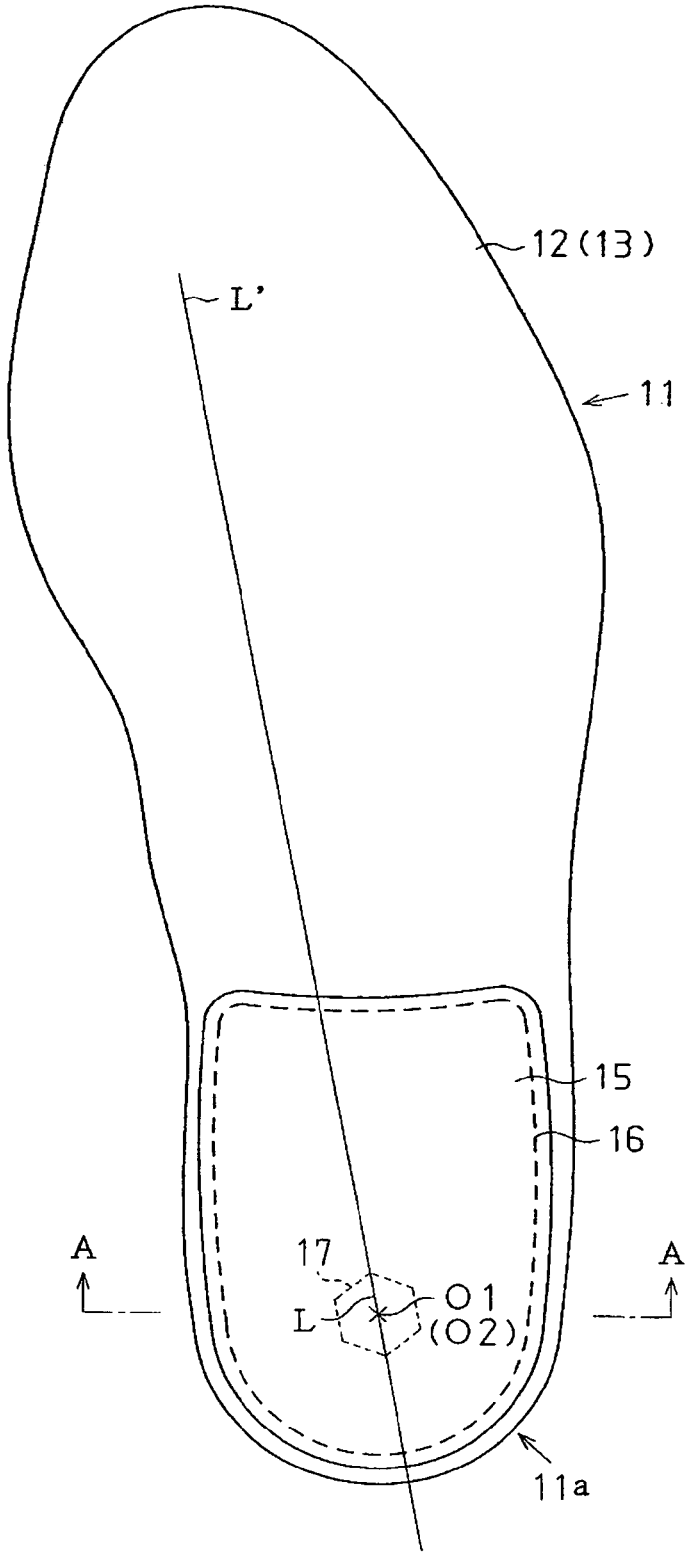
FIG. 1 is a plan view showing an insole according to an embodiment of the present invention.
Figure 2:
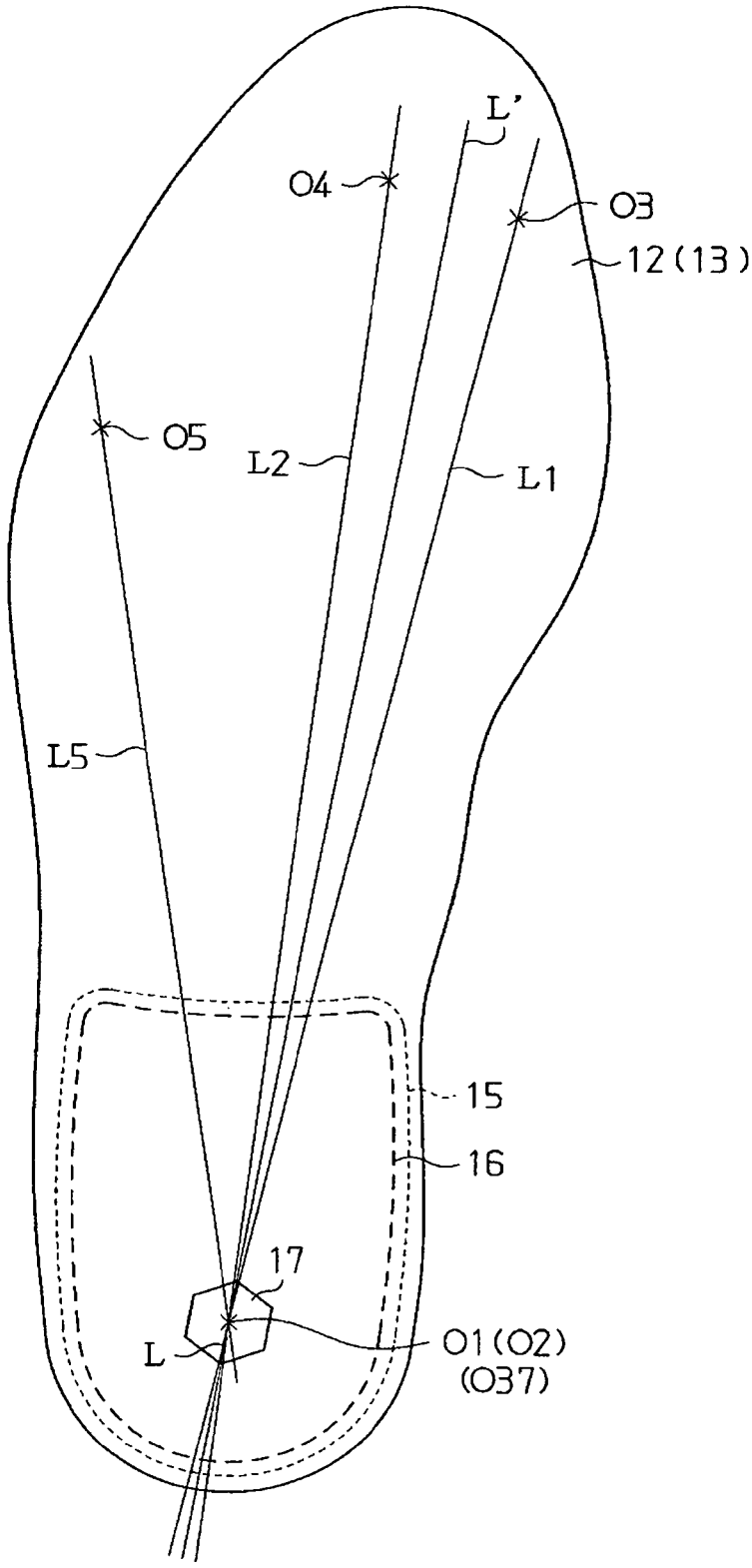
FIG. 2 is a bottom view showing the insole of FIG. 1.
Figure 3:
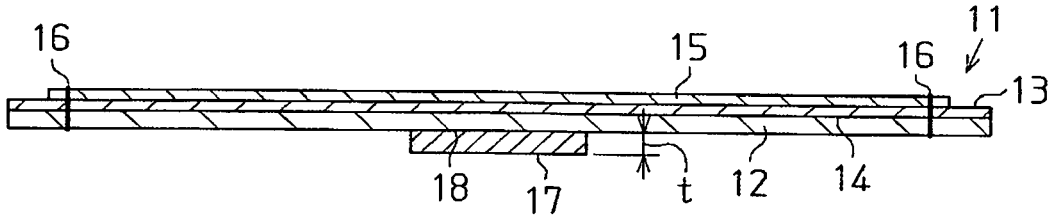
FIG. 3 is a cross-sectional view taken along line A-A of FIG. 1.

Referring to FIG. 1, an insole 11 of the illustrated embodiment has an upper surface that, as a whole, functions as a sole support for supporting the sole of a human foot. The upper surface of the insole 11 includes five toe supports that support the corresponding toe fingers and a heel support 11*a* that supports the heel. The insole 11 includes a body sheet 12 having a shape that substantially coincides with the shape of the sole. The body sheet 12 is made of fabric such as woven fabric, knitted fabric, and unwoven fabric, which is formed of natural fiber including cotton and wool or synthetic fiber. As shown in FIG. 3, a masking sheet 13 is bonded with the upper surface of the body sheet 12 by an adhesive agent 14. The masking sheet 13 is formed of, for example, artificial leather that is subjected to antimicrobial and deodorant treatment. A name sheet 15 is secured to a substantially entire portion of a portion of the upper surface of the masking sheet 13 corresponding to the heel support 11*a* of the insole 11 through sewing by a machine-sewing thread 16 or bonding by an adhesive agent. The name sheet 15 is formed of, for example, artificial or natural leather.

Figure 4:
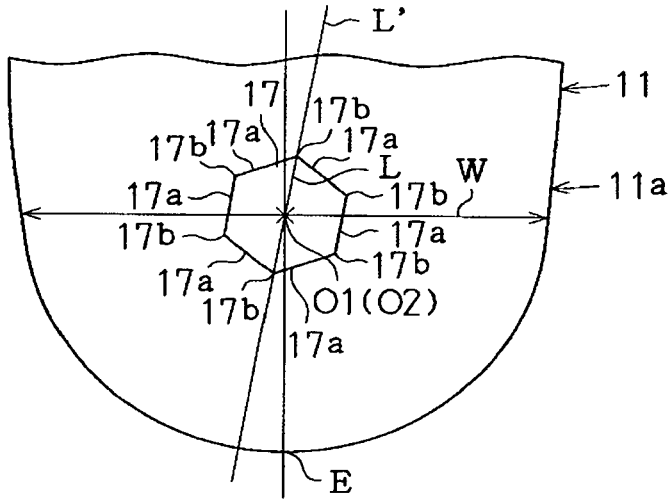
FIG. 4 is a bottom view showing a heel support of the insole of FIG. 1.

As shown in FIGS. 3 and 4, a projection 17 having a plate-like shape is bonded with the bottom surface of the insole 11 by an adhesive agent 18. The projection 17 is formed by a synthetic resin sheet body, a synthetic resin molded body, or a synthetic resin foamed body, which is formed of, for example, polyurethane resin, vinyl chloride resin, acrylic resin, polyethylene resin, or polypropylene resin. As shown in FIG. 4, the projection 17 has an equilateral hexagonal shape as viewed from above. The length of a tangential line L including the center O2 of the hexagonal shape, or the diameter F of a circle circumscribed around the hexagonal shape, is preferably 3 to 28 millimeters, more preferably 5 to 25 millimeters, further preferably 8 to 25 millimeters, and most preferably 12 to 22 millimeters. In the illustrated embodiment, the length of the tangential line L is set to 15 millimeters. The projection amount (the height) t of the projection 17 of FIG. 3 is preferably 0.2 to 6.0 millimeters, more preferably 0.4 to 4.0 millimeters, further preferably 0.7 to 2.4 millimeters, and most preferably 1.0 to 2.2 millimeters. In the illustrated embodiment, the projection amount t is set to 1.8 millimeters. If the projection 17 is formed by, for example, a compressible foamed body, the projection 17 is formed in such a manner that the projection amount t of the projection 17 becomes the aforementioned values in a state compressed by the weight of the wearer. The projection amount t of the projection 17 in a state not compressed by the weight of the wearer is not limited. In a state not compressed by the weight of the wearer, for example, the projection amount t of the projection 17 of the insole 11 that is used in a athletic shoe may be 2 to 4 times the projection amount t of the projection 17 of the insole 11 that is used in a shoe other than the athletic shoe. In other words, in the case of the athletic shoe, the projection amount t of the projection 17 is determined in consideration of the fact that the projection is compressed to between one-quarter and one-half by the weight of a wearer of the footgear.

In the illustrated embodiment, referring to FIG. 4, the center O2 of the projection 17 coincides with the center O1 of the heel support 11*a* of the insole 11. However, the center O2 may be located offset from the center O1 rightward or leftward along a direction defined by a width W and by a margin not greater than 4.5 millimeters. Alternatively or in addition to this, the center O2 may be located offset from the center O1 frontward or rearward by a margin not greater than 8 millimeters.

Normally, referring to FIG. 4, the center O1 of the heel support 11*a* is located at the center of a lateral direction defined by the width of the insole 11 and offset frontward from a rear end E of the insole 11 by a predetermined margin (generally, 14 to 28 millimeters). However, if the center of a calcaneus 37 (the center O37 of a tuber calcanei 37*a* of FIG. 8) does not coincide with the center O1 of the heel support 11*a*, the center O1 of the heel support 11*a* is moved to the position coinciding with the center of the calcaneus 37. The center O2 of the projection 17 is then arranged at the position coinciding with the center O1. Alternatively, the center O2 of the projection 17 may be set to the position offset from the center O1 of the heel support 11*a* rightward or leftward along the direction defined by the width W by a margin not greater than 4.5 millimeters and/or frontward or rearward by a margin not greater than 8 millimeters.

Figure 5:
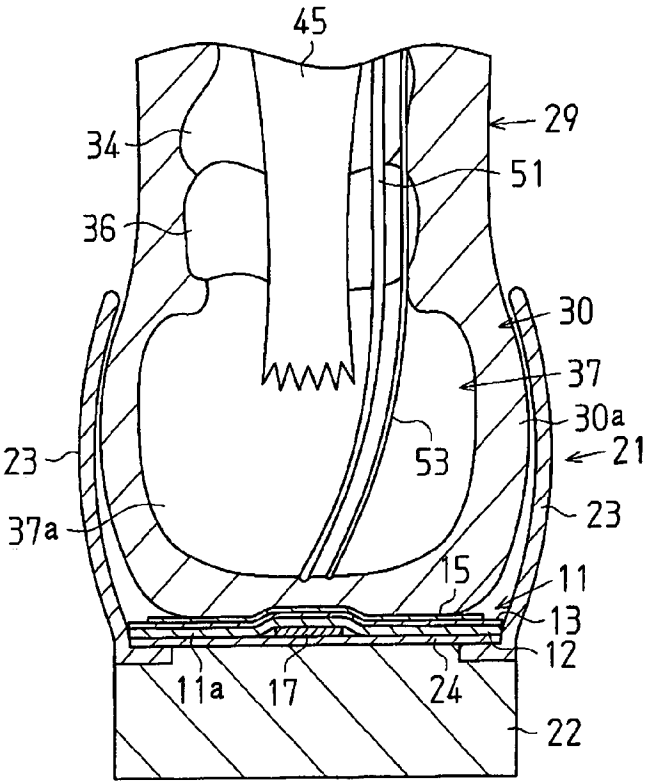
FIG. 5 is a cross-sectional view showing a shoe including the insole of FIG. 1 in a usable state.

As shown in FIG. 5, a shoe 21 includes a bottom material (a heel material) 22 that supports a foot 30. The lower end of a cover portion 23 that covers a heel 30*a* of the foot 30 is bonded with the upper peripheral end of the bottom material 22 by an adhesive agent. An inner bottom 24 is bonded with the upper surface of the bottom material 22 by an adhesive agent. The insole 11 is received in the shoe 21 as mounted on the inner bottom 24. The heel 30*a* of the foot 30 is thus covered by the heel support 11*a* and the cover portion 23. Referring to FIG. 5, an upper surface section of the insole 11 corresponding to the projection 17 becomes elevated when the insole 11 receives the weight of the wearer of the shoe 21. This stimulates a part of the foot 30 in the proximity of the tuber calcanei 37*a*.

There are different nerves in the proximity of the tuber calcanei 37*a*, including lower end portions (termini) of a tibial nerve 51 and a medial sural cutaneous nerve 53, which are automatic nerves vertically extending along rear sides of a tibia 34, a talus 36, and the calcaneus 37. Thus, the elevated portion of the insole 11 corresponding to the projection 17 stimulates the nerves including the tibial nerve 51 and the medial sural cutaneous nerve 53. It has been found by a test that stimulation of the tibial nerve 51 and the medial sural cutaneous nerve 53 promotes blood circulation, which is a significant effect. The effect will hereafter be explained.

The anatomy of a leg 29 and that of the foot 30 will hereafter be explained with reference to FIGS. 6 to 9.

Figure 6:
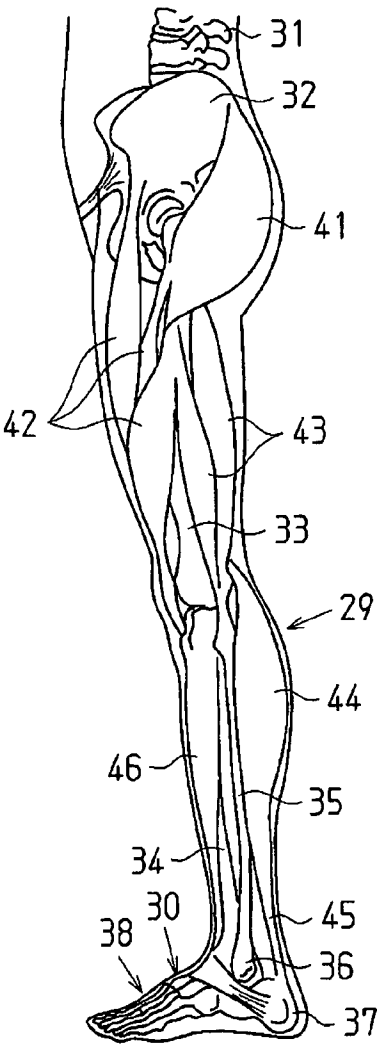
FIG. 6 is a diagram representing the bone structure and the muscles of a human lower body.
Figure 7:
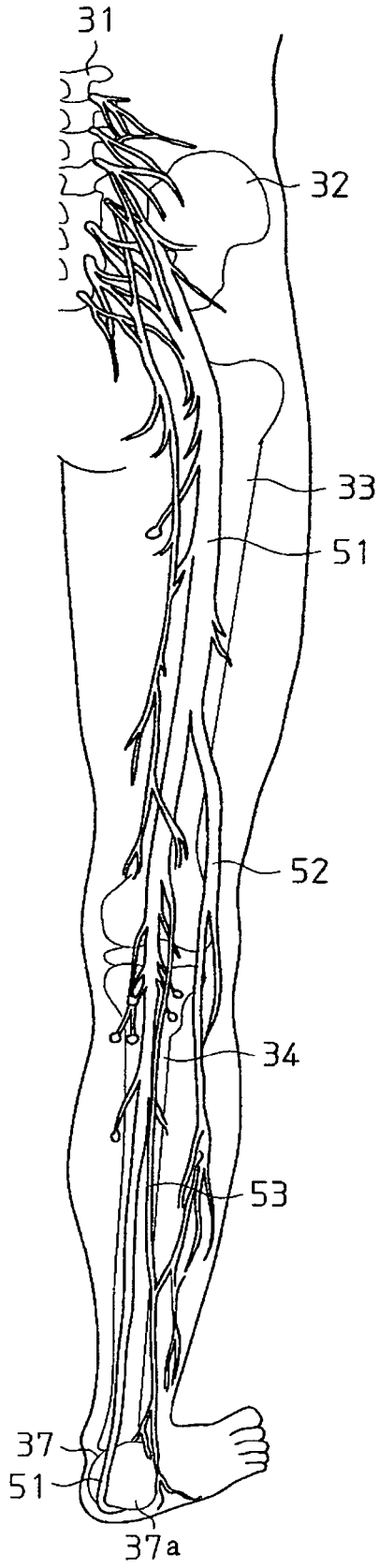
FIG. 7 is a diagram representing the bone structure and the nerves of a human lower limb.

FIGS. 6 and 7 illustrate the lower body including the leg 29 and the foot 30. More specifically, the leg 29 includes a thigh bone 33, the tibia 34, and a fibula 35. The foot 30 includes the talus 36, the calcaneus 37, and a group of toe bones 38. FIGS. 6 and 7 also show a spine 31, a pelvis 32, a musculus gluteus maximus 41, a quadriceps muscle of thigh 42, a biceps muscle of thigh 43, a musculus gastrocnemius 44, an Achilles tendon 45, a frontal tibial muscle 46, the tibial nerve 51, a common peroneal nerve 52, and the medial sural cutaneous nerve 53. Although not illustrated, the common peroneal nerve 52 is divided into a superficial peroneal nerve and a deep peroneal nerve in the frontal side of the leg 29.

Figure 8:
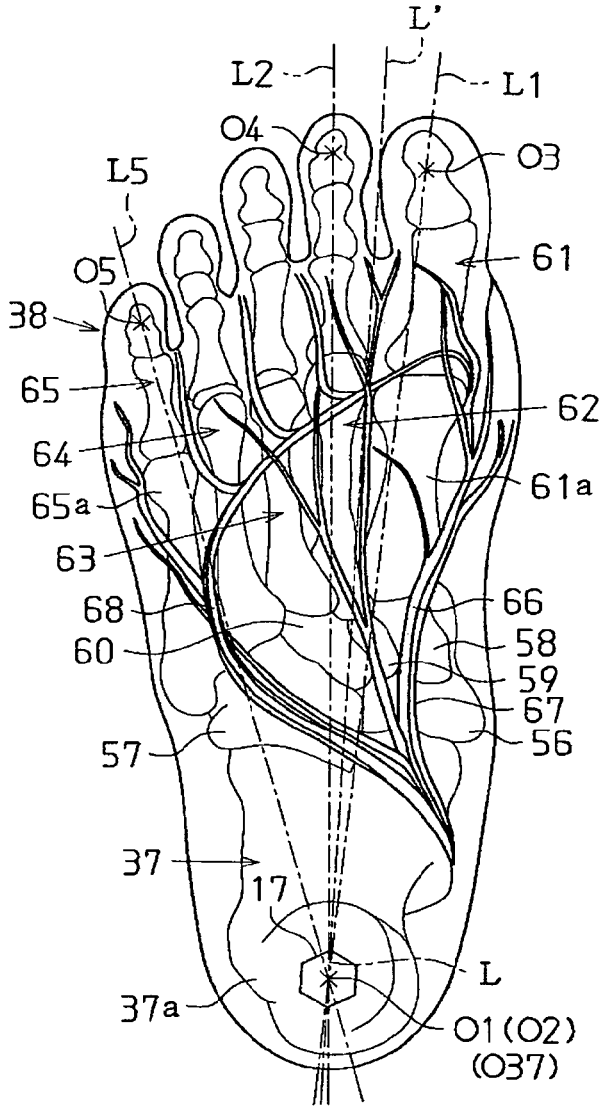
FIG. 8 is a diagram representing the bone structure and the blood vessels of a human foot as viewed from the sole.

FIG. 8 shows the toe bones 38, which are connected to the calcaneus 37. More specifically, the drawing illustrates a navicular bone 56, a cuboid bone 57, a first cuneiform bone 58, a second cuneiform bone 59, a third cuneiform bone 60, a first group of toe bones 61, a second group of toe bones 62, a third group of toe bones 63, a fourth group of toe bones 64, and a fifth group of toe bones 65. Referring to the drawing, the line L1 includes the center O37 of the tuber calcanei 37*a* (the center O1 of the heel support 11*a*) and the center O3 of a distal portion of the first group of toe bones 61 (the center O3 of a first toe support portion shown in FIG. 2). The line L2 includes the center O37 of the tuber calcanei 37*a* and the center O4 of a distal portion of the second group of toe bones 62 (the center O4 of a second toe support portion shown in FIG. 2). The line L5 includes the center O37 of the tuber calcanei 37*a* and the center O5 of a distal portion of the fifth group of toe bones 65 (the center O5 of a fifth toe support portion shown in FIG. 2). The projection 17 is oriented in such a manner that the extending line L' of one diagonal line L of the projection 17 that includes the center O2 extends preferably between the line L1 and the line L5, and more preferably on a midline between the line L1 and the line L2.

Figure 9:
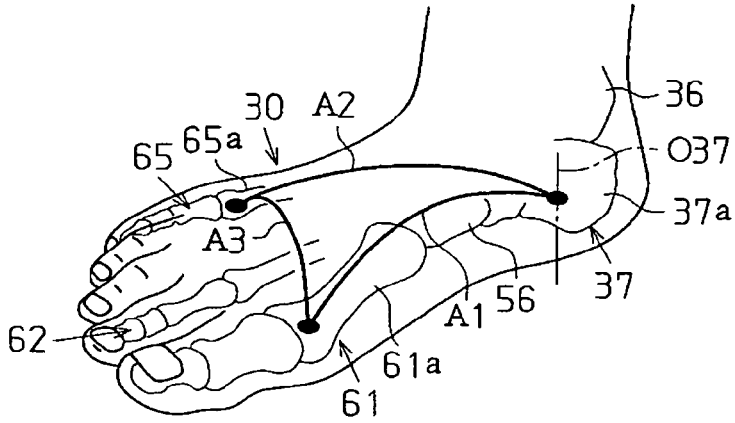
FIG. 9 is a perspective view showing an arch of a human sole.
Figure 10A:
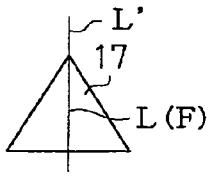
FIGS. 10A to 10L are plan views showing projections of insoles according to different embodiments of the present invention.
Figure 10B:
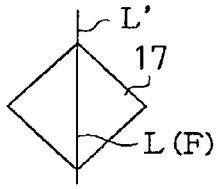
Figure 10C:
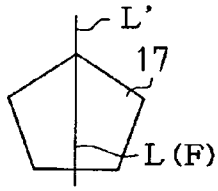
Figure 10D:
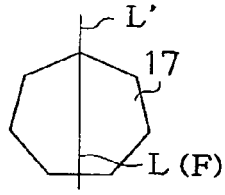
Figure 10E:
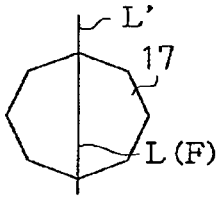
Figure 10F:
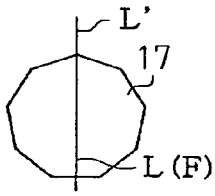
Figure 10G:
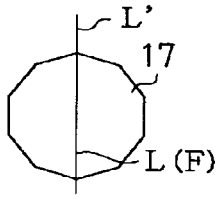
Figure 10H:
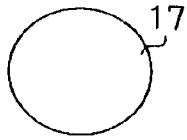
Figure 10I:
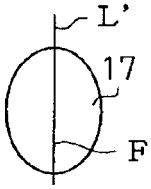
Figure 10J:
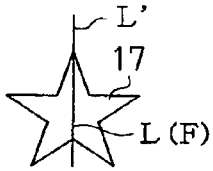
Figure 10K:
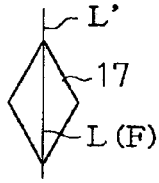
Figure 10L:
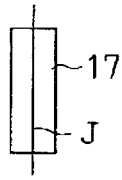

As shown in FIG. 9, the inner longitudinal arch A1 extends between the center O37 of the tuber calcanei 37*a* and a distal portion of a first metatarsal bone 61*a* of the first group of toe bones 61. The outer longitudinal arch A2 extends between the center O37 of the tuber calcanei 37*a* and a distal portion of a fifth metatarsal bone 65*a* of the fifth group of toe bones 65. The lateral arch A3 extends between the distal portion of the first metatarsal bone 61*a* and the distal portion of the fifth metatarsal bone 65*a*.

The projection 17 stimulates the termini of the tibial nerve 51 and the medial sural cutaneous nerve 53, which are located in the proximity of the tuber calcanei 37*a*. The effect produced by such stimulation will hereafter be described with reference to FIGS. 5 to 8.

As shown in FIG. 6, the musculus gluteus maximus 41, the quadriceps muscle of thigh 42, the biceps muscle of thigh 43, the musculus gastrocnemius 44, and the frontal tibial muscle 46 are connected to the tibial nerve 51 and the medial sural cutaneous nerve 53. Accordingly, the stimulation of the termini of the tibial nerve 51 and the medial sural cutaneous nerve 53 by the projection 17 corrects flaccidity of the muscles 41, 42, 43, 44, 46, thus normalizing the positions of the muscles 41 to 44 and 46. This normalizes movement of the muscles 41 to 44 and 46, relieving the associated arteries and veins from pressure. The actions of these vessels are thus normalized. Further, normalized movement of the musculus gluteus maximus 41 restores the normal lateral equilibrium in the pelvis 32. The erector muscle of spine, the broadest muscle of back, and the trapezius muscle (neither is shown) are also normalized, thus normalizing the function of the spine. This promotes the systemic blood circulation and activates the automatic nervous system.

Further, the stimulation of the tibial nerve 51 and the medial sural cutaneous nerve 53 normalizes the position of the Achilles tendon 45, which is connected to the musculus gastrocnemius 44, as shown in FIG. 6. This corrects the deformed shapes of the arches A1 to A3, allowing a smooth weight shift in walking. A plantar artery 66, a plantar vein 67 and a plantar arch 68 of FIG. 8, and toe capillaries are also stimulated through the stimulation of the tibial nerve 51 and the medial sural cutaneous nerve 53. This promotes the blood circulation of the foot 30 in walking. Further, the impact acting on the bone structure of the foot 30 when the heel 30*a* hits the ground is reduced, thus relieving the fatigability of the foot 30 in walking.

In order to prove the effect of the projection 17 formed in the insole 11, a test was carried out in the following manner.

The test was performed using the insoles 11 configured differently for examples 1 to 5 and comparative example 1. More specifically, the insole 11 of example 1 had the projection 17 formed in such a manner that the center O2 of the projection 17 coincided with the center O1 of the heel support 11*a*. The insole 11 of example 2 had the projection 17 formed in such a manner that the center O2 of the projection 17 was located offset frontward from the center O1 of the heel support 11*a* by a margin of four millimeters. The insole 11 of example 3 had the projection 17 formed in such a manner that the center O2 of the projection 17 was located offset frontward from the center O1 of the heel support 11*a* by a margin of eight millimeters. The insole 11 of example 4 had the projection 17 formed in such a manner that the center O2 of the projection 17 was located offset rearward from the center O1 of the heel support 11*a* by the margin of four millimeters. The insole 11 of example 5 had the projection 17 formed in such a manner that the center O2 of the projection 17 was located offset rearward from the center O1 of the heel support 11*a* by the margin of eight millimeters. The insole 11 of comparative example 1 does not have the projection 17. The projections 17 of examples 1 to 5 each have an equilateral hexagonal cross-sectional shape. The diameter F of a circle circumscribed around the hexagonal shape is 15 millimeters. The projections 17 are formed by cutting a slightly foamed sheet of polyurethane resin. The projection amount t of each projection 17 is set to 1.5 millimeters in a state compressed by the weight of the wearer.

The test was performed using the shoes that incorporate the insoles 11 of examples 1 to 5 and comparative example 1. For each one of the examples, a test subject wore the corresponding pair of shoes and walked 200 steps. After an interval of several minutes, different measurements were taken. The results are shown in Tables 1 and 2. Table 2 shows the ratio of low frequency component (LF) with respect to the high frequency component (HF) as an indicator of sympathetic nerve activity and the HF as an indicator of parasympathetic nerve activity for each example. The values were obtained through variable spectrum analysis using fast Fourier transformation based on four types of data, which are electrocardiogram, respiration rate, heart rate, and blood pressure.

TABLE 1

| | Average Heart Rate | Blood Pressure (Systolic) |
|---|---|---|
| Comparative example 1 | 60/min. | 97 mmHg |
| Example 1 | 66/min. | 119 mmHg |
| Example 2 | 60/min. | 100 mmHg |
| Example 3 | 60/min. | 96 mmHg |
| Example 4 | 62/min. | 98 mmHg |
| Example 5 | 60/min. | 94 mmHg |

TABLE 2

| | Sympathetic Nerve Activity (LF/HF) | Parasympathetic Nerve Activity (HF) |
|---|---|---|
| Comparative example 1 | 0.857 | 0.085 |
| Example 1 | 1.567 | 0.043 |
| Example 2 | 0.935 | 0.068 |
| Example 3 | 0.923 | 0.067 |
| Example 4 | 0.946 | 0.073 |
| Example 5 | 0.943 | 0.079 |

As is clear from Table 2, the sympathetic nerve activity (LF/HF) was increased and the parasympathetic nerve activity (HF) was decreased in examples 1 to 5 compared to comparative example 1. Increase of the sympathetic nerve activity and decrease of the parasympathetic nerve activity were pronounced particularly in example 1 in which the center O2 of the projection 17 coincides with the center O1 of the heel support 11*a*, or the center O37 of the tuber calcanei 37*a* of the foot 30. The increase of the sympathetic nerve activity and the decrease of the parasympathetic nerve activity are thought to be attributed to stimulation of the lateral plantar nerve (the tibial nerve 51 and the common peroneal nerve 52) by the projection 17.

As indicated by Table 1, the heart rate and the blood pressure were increased in example 1 compared to comparative example 1. The fact indicates increase of the blood flow. Contrastingly, no significant differences of the heart rate and the blood pressure were noted between examples 2 to 5 and comparative example 1. In examples 2 to 5, the projection 17 was located offset frontward or rearward. Accordingly, it has been confirmed preferable that the projection 17 be formed in such a manner that the center O2 of the projection 17 coincides with the center O1 of the heel support 11*a*.

Next, in order to observe differences of effects caused by differently shaped projections 17, the following test was performed. In the test, the insole 11 of comparative example 2 had no projection 17. The insoles 11 of the other examples had the projections 17 having an equilateral triangular shape (example 6), a square shape (example 7), an equilateral pentagonal shape (example 8), an equilateral hexagonal shape (example 9), an equilateral heptagonal shape (example 10), an equilateral octagonal shape (example 11), an equilateral enneagonal shape (example 12), and a circular shape (example 13) as viewed from above. The test was performed using the shoes incorporating the insoles 11 of examples 6 to 13 and comparative example 2. More specifically, a test subject wore the corresponding pair of shoes and walked 200 steps for each of the examples. After an interval of several minutes, different measurements were taken. The result is shown in Tables 3 and 4. In examples 6 to 13, the projections 17 were formed of polyurethane resin through molding in a slightly foamed manner. In each of the examples 6 to 12, the diameter of the circle circumscribed around the projection 17 as viewed from above was 15 millimeters. Similarly, in example 13, the diameter of the circular shape of the projection 17 as viewed from above was 15 millimeters. The projection amount t of the projection 17 of each of examples 6 to 13 was 1.8 millimeters in a state compressed by the weight of the wearer. In examples 6 to 13, the center O2 of the projection 17 coincided with the center O1 of the heel support 11*a*.

TABLE 3

| | Average Heart Rate | Blood Pressure (Systolic) |
|---|---|---|
| Comparative example 2 | 60/min. | 97 mmHg |
| Example 6 | 61/min. | 95 mmHg |
| Example 7 | 60/min. | 100 mmHg |
| Example 8 | 67/min. | 117 mmHg |
| Example 9 | 70/min. | 120 mmHg |
| Example 10 | 66/min. | 110 mmHg |
| Example 11 | 68/min. | 118 mmHg |
| Example 12 | 60/min. | 100 mmHg |
| Example 13 | 60/min. | 97 mmHg |

TABLE 4

| | Sympathetic Nerve Activity (LF/HF) | Parasympathetic Nerve Activity (HF) |
|---|---|---|
| Comparative example 2 | 0.857 | 0.085 |
| Example 6 | 1.211 | 0.063 |
| Example 7 | 1.223 | 0.063 |
| Example 8 | 1.235 | 0.065 |
| Example 9 | 1.689 | 0.035 |
| Example 10 | 1.245 | 0.059 |
| Example 11 | 1.233 | 0.059 |
| Example 12 | 1.172 | 0.063 |
| Example 13 | 1.157 | 0.072 |

As indicated by Table 3, the heart rate and the blood pressure were increased in example 9 compared to comparative example 2. Also, as shown in Table 4, the sympathetic nerve activity was increased and the parasympathetic nerve activity was decreased in examples 6 to 13 compared to comparative example 2. Increase of the sympathetic nerve activity and decrease of parasympathetic nerve activity were pronounced particularly in example 9, in which the projection 17 had the equilateral hexagonal shape as viewed from above. Accordingly, it has been concluded that the projection 17 preferably has an equilateral hexagonal shape as viewed from above.

Generally, it is believed optimal that, after the heel 30*a* hits the ground, the center of gravity of a walker shifts from the center O1 of the tuber calcanei 37*a* toward the midpoint between the center O3 of the distal portion of the first group of toe bones 61 and the center O4 of the second group of toe bones 62. For ensuring such shift of the center of gravity, it is preferred that the projection 17 have the equilateral hexagonal shape as viewed from above and that the extending line L' of one diagonal line L of the projection 17 that includes the center O2 extends on the midline between the lines L1, L2. That is, it is assumed that, in walking, this configuration particularly improves the stimulation efficiency of the tibial nerve 51 and the medial sural cutaneous nerve 53 by a point 17*b* of the projection 17, which is shown in FIG. 4.

Further, in order to observe differences of effects brought about by the projections 17 having different projection amounts t, the following test was carried out. In the test, the insole 11 of comparative example 3 has no projection 17. The insoles 11 of the other examples had the projection amounts t that were 0.2 millimeters (example 14), 0.5 millimeters (example 15), 0.8 millimeters (example 16), 1.8 millimeters (example 17), 2.2 millimeters (example 18), 2.8 millimeters (example 19), 3.5 millimeters (example 20), 4.0 millimeters (example 21), and 6.0 millimeters (example 22), in states compressed by the weight of the wearer. The test was performed with the shoes incorporating the insoles 11 of examples 14 to 22 and comparative example 3. More specifically, for each of the example, a test subject wore the corresponding pair of shoes and walked 200 steps. After an interval of several minutes, different measurements were taken. The results are shown in Tables 5 and 6. The projections 17 of examples 14 to 22 had the equilateral hexagonal shapes as viewed from above and the diameter F of the circle circumscribed around the hexagonal shape of each projection 17 was 15 millimeters. The projections 17 were each formed of polyurethane resin through molding in a slightly foamed manner. In examples 14 to 22, the center O2 of the projection 17 coincides with the center O1 of the heel support 11*a*.

TABLE 5

| | Average Heart Rate | Blood Pressure (Systolic) |
|---|---|---|
| Comparative example 3 | 60/min. | 97 mmHg |
| Example 14 | 62/min. | 98 mmHg |
| Example 15 | 60/min. | 100 mmHg |
| Example 16 | 62/min. | 99 mmHg |
| Example 17 | 72/min. | 122 mmHg |
| Example 18 | 64/min. | 102 mmHg |
| Example 19 | 63/min. | 106 mmHg |
| Example 20 | 63/min. | 100 mmHg |
| Example 21 | 63/min. | 100 mmHg |
| Example 22 | 62/min. | 100 mmHg |

TABLE 6

| | Sympathetic Nerve Activity (LF/HF) | Parasympathetic Nerve Activity (HF) |
|---|---|---|
| Comparative example 3 | 0.857 | 0.085 |
| Example 14 | 0.883 | 0.082 |
| Example 15 | 0.965 | 0.069 |
| Example 16 | 0.979 | 0.067 |
| Example 17 | 1.489 | 0.032 |
| Example 18 | 1.194 | 0.066 |
| Example 19 | 1.192 | 0.064 |
| Example 20 | 1.189 | 0.059 |
| Example 21 | 1.143 | 0.060 |
| Example 22 | 1.156 | 0.062 |

As indicated by Table 6, the sympathetic nerve activity was increased and the parasympathetic nerve activity was decreased in examples 14 to 22 compared to comparative example 3. Increase of the sympathetic nerve activity and decrease of the parasympathetic nerve activity were pronounced particularly in example 17, in which the projection amount t of the projection 17 is 1.8 millimeters. Further, as is clear from Table 5, the heart rate and the blood pressure were increased in example 17 compared to comparative example 3. Accordingly, it has been concluded preferable that the projection amount t of the projection 17 be 1.8 millimeters. The human skin is formed of three layers, or epidermis, dermis, and subcutaneous tissue. The thickness of the epidermis is approximately 0.12 millimeters, the thickness of the dermis is approximately 1.8 millimeters, and the thickness of the subcutaneous tissue is approximately 0.08 millimeters. The total of thicknesses of the three layers, or the thickness of the skin, is thus approximately 2 millimeters. Accordingly, it is preferred that the projection amount t of the projection 17 be slightly smaller than the thickness of the skin.

The illustrated embodiment may be modified as follows.

As shown in FIGS. 10A to 10L, the projection 17 may have an equilateral triangular shape, a square shape, an equilateral pentagonal shape, an equilateral heptagonal shape, an equilateral octagonal shape, an equilateral enneagonal shape, an equilateral decagonal shape, a circular shape, an oval shape, a star shape, a rhomboidal shape, or a rectangular shape, as viewed from above. If the projection 17 has a polygonal shape as viewed from above, it is preferred that the extending line L' of one diagonal line L that includes the center and a corresponding point of the polygonal shape extend on the midline between the lines L1 and L5. If the projection 17 has the oval shape as viewed from above, it is preferred that the extending line L' of the longitudinal axis of the oval extend on the midline between the lines L1 and L5. If the projection 17 has the rectangular shape of FIG. 10L as viewed from above, it is preferred that the longitudinal axis J of the rectangle extend on the midline between the lines L1 and L5. Further, if the projection 17 has the equilateral polygonal shape as viewed from above, the diameter F of the circle circumscribed around the polygon is preferably 3 to 28 millimeters, more preferably 5 to 25 millimeters, further preferably from 8 to 25 millimeters, and most preferably 12 to 22 millimeters. If the projection 17 has the circular shape as viewed from above, it is preferred that the diameter of the circle is set in the same manner as the diameter F. If the projection 17 has the oval shape as viewed from above, it is preferred that the length F of the longitudinal axis of the oval is set in the same manner as the diameter F. If the projection 17 has the star shape of FIG. 10J as viewed from above, it is preferred that the length F of the diagonal line L including the center of the star is set in the same manner as the diameter F. If the projection 17 has the rhomboidal shape as viewed from above, it is preferred that the length F of a longer diagonal line L including the center of the rhomboidal is set in the same manner as the diameter F.

Figure 11:
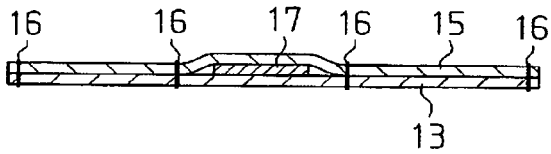
FIG. 11 is a cross-sectional view showing an insole according to another embodiment of the present invention.

As shown in FIG. 11, the projection 17 may be arranged between the masking sheet 13 and the name sheet 15. In this case, the name sheet 15 may be secured to the masking sheet 13 around the projection 17 through sewing by the machine-sewing thread 16 or bonding by the adhesive agent.

Figure 12:
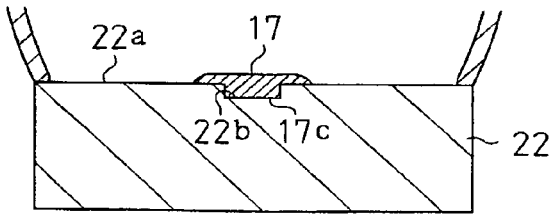
FIG. 12 is a cross-sectional view showing a shoe according to another embodiment of the present invention.

As shown in FIG. 12, a recess 22*b* may be formed in an upper surface 22*a* of the bottom material 22 of the shoe 21. In this case, a projecting portion 17*c* is provided on the lower surface of the projection 17. The projection 17 is thus secured to the shoe 21 by fitting the projecting portion 17*c* in the recess 22*b*. Alternatively, although not illustrated, the projection 17 may be bonded directly with the upper surface of the bottom material 22 of the shoe 21 or the inner bottom 24 using an adhesive agent.

Figure 13A:
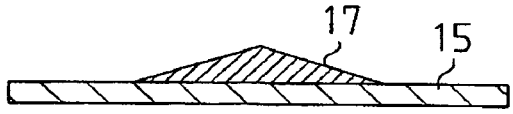
FIGS. 13A and 13B are cross-sectional views showing name sheets and projections of insoles according to different embodiments of the present invention.
Figure 13B:
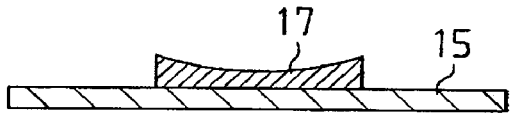

As shown in FIGS. 13A and 13B, the upper or lower surface of the projection 17 may be formed in a convex shape in a spike-like manner or in a concave shape.

Figure 14:
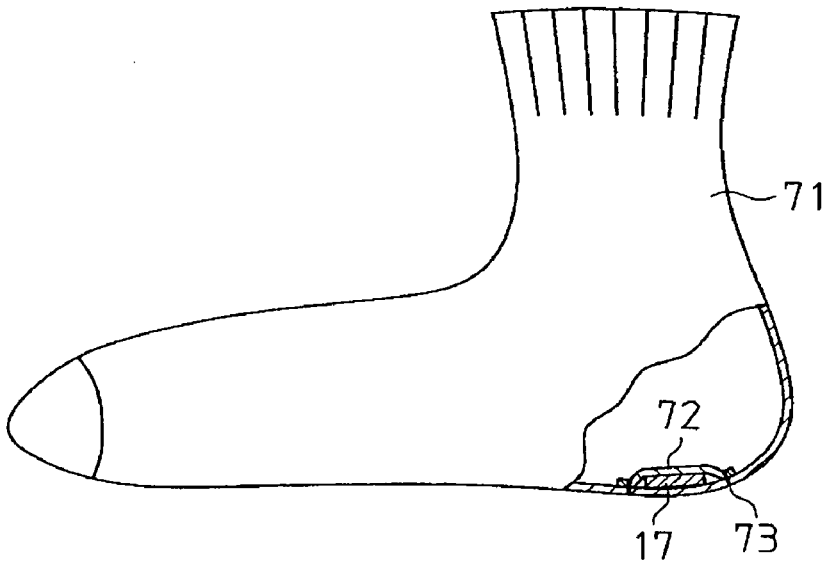
FIG. 14 is a partially exploded side view showing a sock according to another embodiment of the present invention.

As shown in FIG. 14, the projection 17 may be formed in a sock 71 as footgear using a cloth 72 and a thread 73. In this case, it is preferred that at least a heel portion of the sock 71 be formed of material having relatively low flexibility. This adapts the position of the projection 17 to an optimal position.

Figure 15:
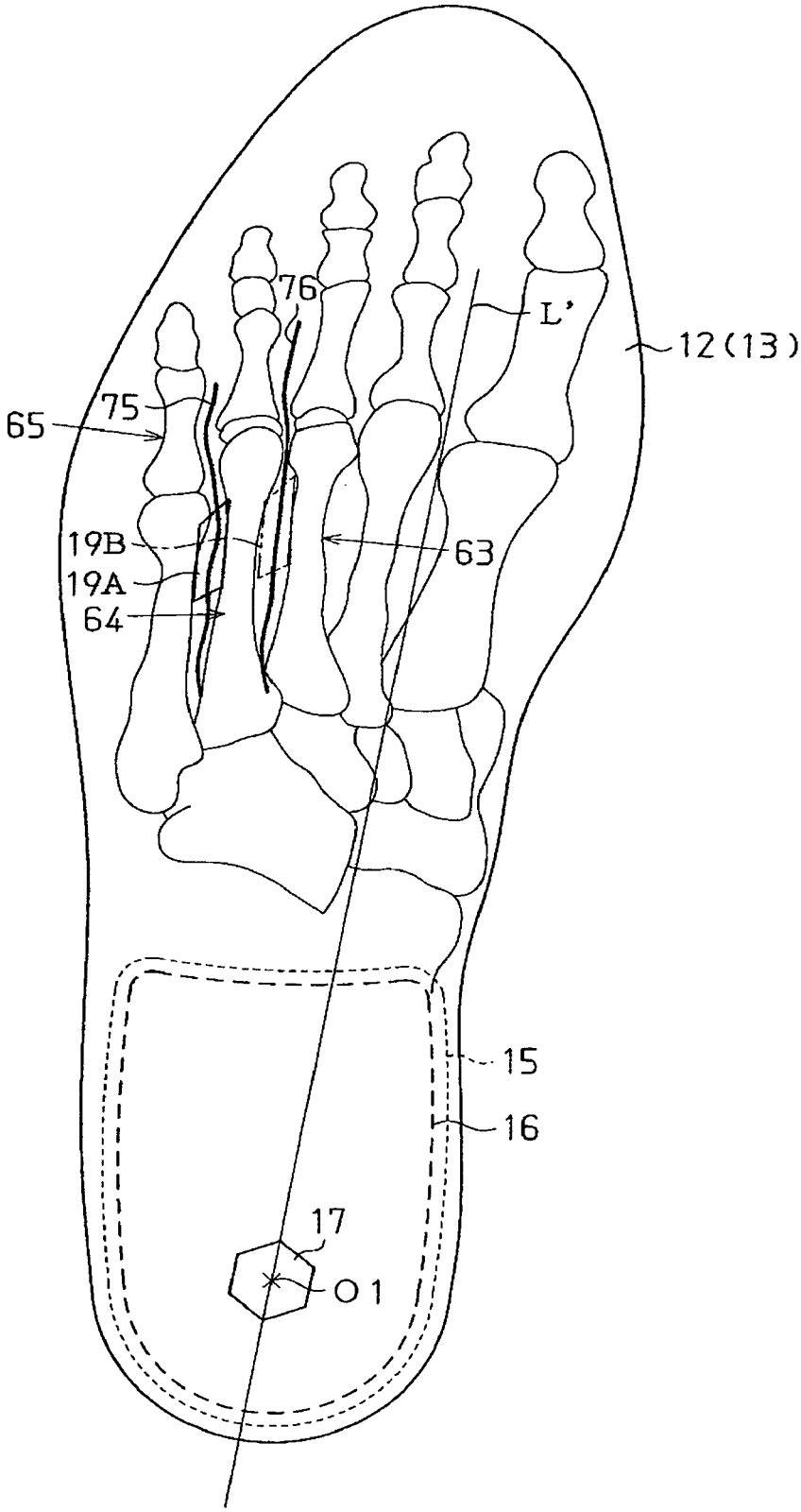
FIG. 15 is a bottom view showing an insole according to another embodiment of the present invention.

Referring to FIG. 15, a projection 19A may be provided in a portion of the insole 11 corresponding to a fourth common plantar digital nerve 75. The projection 19A may have a plate-like shape. Further, the position of the projection 19A relative to the sole support may be changeable. The fourth common plantar digital nerve 75 is located between the fifth group of toe bones 65 and the fourth group of toe bones 64 and connected to the lateral plantar nerve. The projection 19A stimulates the fourth common plantar digital nerve 75. Such stimulation normalizes the functions of the muscles and the plantar arch 68 (see FIG. 8) of each lower limb, promoting the blood circulation.

Alternatively or in addition to this, a projection 19B may be provided in a portion of the insole 11 corresponding to a third common plantar digital nerve 76. The projection 19B may have a plate-like shape. Further, the position of the projection 19B relative to the sole support may be changeable. The third common plantar digital nerve 76 is located between the fourth group of toe bones 64 and the third group of toe bones 63 and connected to the medial plantar nerve. The projection 19B stimulates the third common plantar digital nerve 76. Such stimulation normalizes the functions of the muscles and the plantar arch 68 (FIG. 8) of each lower limb, promoting the blood circulation.

The projections 19A and 19B each may have a rectangular shape, a parallelogrammatic shape, or a crescent shape as viewed from above, instead of the shapes shown in FIG. 15.

Figure 16:
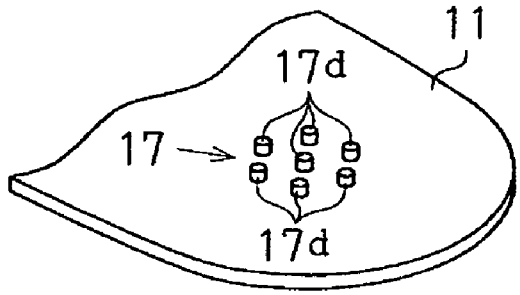
FIGS. 16 and 17 are perspective views showing portions of insoles according to different embodiments of the present invention.
Figure 17:
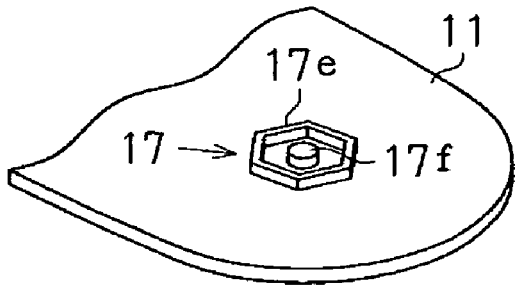

The projection 17 may be formed by a group of small projections 17*d* as shown in FIG. 16 or by a combination of a hexagonal ring 17*e* and a small projection 17*f* as shown in FIG. 17. The small projection 17*f* may be a permanent magnet.

Figure 18:
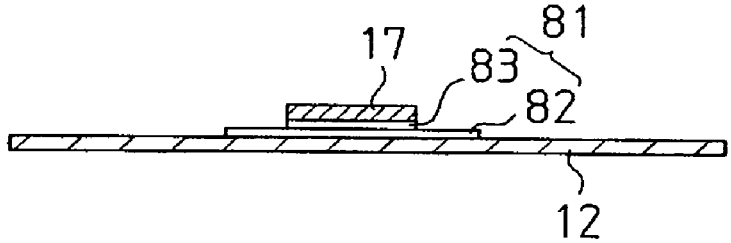
FIG. 18 is a cross-sectional view showing an insole according to another embodiment of the present invention.

Referring to FIG. 18, the projection 17 may be secured to the body sheet 12 using a hook-and-loop fastener 81. More specifically, a hook portion 82 is applied to the body sheet 12 and a loop portion 83 is applied to the projection 17. This structure makes it easy for the wearer to change the position of the projection 17 in such a manner that the center O2 of the projection 17 coincides with the center O37 of the tuber calcanei 37*a*.

A plurality of recesses may be defined in the upper surface of the bottom material 22 of the shoe 21 while a single projection is provided on the bottom surface of the projection 17. The projection 17 is secured to the shoe 21 by fitting the projection 17 in one of the recesses. This structure makes it easy for the wearer to change the position of the projection 17 in such a manner that the center O2 of the projection 17 coincides with the center O37 of the tuber calcanei 37*a*.

The projection 17 may be arranged on the upper surface of the name sheet 15, instead of the bottom surface of the body sheet 12. In this case, to improve the comfort of wearing, it is preferred that the projection 17 be formed of soft material exhibiting improved impact absorbing performance, such as foamed resin.

An adhesive agent may be applied to the bottom surface of the projection 17, and a surface formed by the adhesive agent may be covered by a removable film. The projection 17 is used in a state bonded with footgear or an insole after the film is removed.

The body sheet 12 may be formed of artificial leather, vinyl chloride resin, or natural leather, instead of the fabric such as woven fabric, knitted fabric, and unwoven fabric.

The projection 17 may be formed of, instead of the synthetic resin, natural resin or its foamed body, synthetic or natural rubber or its foamed body, a woven or knitted or unwoven product of synthetic or natural fabric, artificial or natural leather, or cork. Alternatively, the projection 17 may be formed of metal such as gold, silver, copper, aluminum, steel, and stainless steel, ceramic, glass, natural infrared emitting stones, magnets, or artificial stones.

Although the illustrated embodiment is embodied as the shoe or the sock, the present invention may be applied to other types of footgear including the clogs, the slippers, the sandals, the high heels, and Japanese tabi socks. Alternatively, the present invention may be applied to insoles installed in these types of footgear.

The inner bottom of the footgear may be formed by a sheet of compressed pulp, a leather sheet, or an unwoven fabric. The projection 17 may be formed on a surface of the inner bottom.

Further, the bottom material of the footgear may be formed of rubber, leather, or synthetic resin. The projection 17 may be arranged on a surface of the bottom material.

The invention claimed is:

1. Footgear having a sole support that supports the sole of the foot, the sole support including a heel support supporting the heel, the footgear comprising a projection formed on the heel support for pressing and stimulating a nerve in the proximity of the tuber calcanei of the foot, the projection having an equilateral hexagonal shape as viewed from above.

2. The footgear according to claim 1, wherein the sole support further includes a first toe support that supports a first toe and a fifth toe support that supports a fifth toe, and wherein one of lines each including the center and a corresponding point of the equilateral hexagonal shape is located between a line including the center of the heel support and the center of the first toe support and a line including the center of the heel support and the center of the fifth toe support.

3. The footgear according to claim 1, wherein the sole support further includes a first toe support that supports a first toe and a second toe support that supports a second toe, and wherein one of lines each including the center and a corresponding point of the equilateral hexagonal shape is located between a line including the center of the heel support and the center of the first toe support and a line including the center of the heel support and the center of the second toe support.

4. The footgear according to claim 1, wherein the diameter of a circle circumscribed around the equilateral hexagonal shape is 3 to 28 millimeters.

5. The footgear according to claim 4, wherein the diameter of the circle circumscribed around the equilateral hexagonal shape is 8 to 22 millimeters.

6. The footgear according to claim 5, wherein the diameter of the circle circumscribed around the equilateral hexagonal shape is 12 to 20 millimeters.

7. The footgear according to claim 1, wherein the height of the projection is 0.2 to 6.0 millimeters.

8. The footgear according to claim 7, wherein the height of the projection is 0.5 to 4.0 millimeters.

9. The footgear according to claim 8, wherein the height of the projection is 1.0 to 2.2 millimeters.

10. The footgear according to claim 7, wherein the footgear is an athletic shoe and the projection is made from a compressible material and the height of the projection is determined in consideration of the fact that the projection is compressed to between one-quarter and one-half by the weight of a wearer of the footgear.

11. The footgear according to claim 1 further comprising an additional projection provided on the sole support for pressing and stimulating a third common plantar digital nerve.

12. The footgear according to claim 1 further comprising an additional projection provided on the sole support for pressing and stimulating a fourth common plantar digital nerve.

13. The footgear according to claim 1, wherein the position of the projection relative to the heel support is changeable.

14. The footgear according to claim 1, wherein the projection is provided on the underside of the heel support.

15. The footgear according to claim 1, wherein the projection is configured to press and stimulate said nerve at a vertex of the equilateral hexagonal shape.

16. The footgear according to claim 1, wherein the footgear comprises a single said projection formed on the heel support for pressing and stimulating a nerve in the sole of the foot.

17. An insole having a sole support that supports the sole of the foot, the sole support including a heel support that supports the heel, the insole comprising a projection provided on the heel support for pressing and stimulating a nerve in the proximity of the tuber calcanei of the foot, the projection having an equilateral hexagonal shape as viewed from above.

18. The insole according to claim 17, wherein the projection is provided on the underside of the heel support.

19. The insole according to claim 17, wherein the projection is configured to press and stimulate said nerve at a vertex of the equilateral hexagonal shape.

20. The insole according to claim 17, wherein the insole comprises a single said projection formed on the heel support for pressing and stimulating a nerve in the sole of the foot.

* * * * *

UNITED STATES PATENT AND TRADEMARK OFFICE

CERTIFICATE OF CORRECTION

PATENT NO. : 7,584,556 B2
APPLICATION NO. : 11/340405
DATED : September 8, 2009
INVENTOR(S) : Fujita et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 898 days.

Signed and Sealed this

Fourteenth Day of September, 2010

David J. Kappos

David J. Kappos
*Director of the United States Patent and Trademark Office*